US005823429A

United States Patent [19]

Beck et al.

[11] Patent Number: 5,823,429

[45] Date of Patent: Oct. 20, 1998

[54] HYBRID HYDRAULIC ELECTRONIC UNIT INJECTOR

[75] Inventors: Niels J. Beck, Bonita; Robert L. Barkhimer, Poway, both of Calif.

[73] Assignee: Servojet Products International, San Diego, Calif.

[21] Appl. No.: 678,201

[22] Filed: Jul. 12, 1996

[51] Int. Cl.[6] ..... F02D 1/06; F02M 41/16; F02M 47/02

[52] U.S. Cl. ..... 239/5; 239/88; 239/96

[58] Field of Search ..... 239/5, 88, 96

[56] References Cited

U.S. PATENT DOCUMENTS

| | | | |
|---|---|---|---|
| Re. 33,270 | 7/1990 | Beck et al. | 239/96 X |
| 2,985,378 | 5/1961 | Falberg | 239/96 |
| 3,115,304 | 12/1963 | Humphries | 239/90 |
| 4,605,166 | 8/1986 | Kelly | 239/96 |
| 4,674,688 | 6/1987 | Kanesaka | 239/533.8 |
| 5,191,867 | 3/1993 | Glassey | 123/446 |
| 5,241,935 | 9/1993 | Beck et al. | 123/300 |
| 5,287,838 | 2/1994 | Wells | 123/467 |
| 5,392,745 | 2/1995 | Beck | 123/295 |
| 5,429,309 | 7/1995 | Stockner | 239/88 X |
| 5,460,329 | 10/1995 | Sturman | 239/96 |
| 5,522,545 | 6/1996 | Camplin et al. | 239/92 |

OTHER PUBLICATIONS

*HEUI—A New Direction for Diesel Engine Fuel Systems,* S.F. Glassey, A.R. Stockner, and M.A. Flinn, Caterpillar Inc., SAE Technical Paper Series, No. 930270.

*Primary Examiner*—Andres Kashnikow
*Assistant Examiner*—Robin O. Evans
*Attorney, Agent, or Firm*—Nilles & Nilles, S.C.

[57] ABSTRACT

A hybrid hydraulic electronic unit injector (HEUI) assembly, having some characteristics of an accumulator-type assembly and some characteristics of a non-accumulator type assembly, is produced by designing the volume ($V_{ACC}$) of the passageway downstream of an existing blowback prevention check valve of the assembly to be between 1.0 and 10.0 times the maximum quantity $Q_{MAX}$ of fuel injected during an injection event. The resulting hybrid assembly 1) exhibits a rising injection rate during at least the initial stages of the injection event and therefore exhibits benefits generally associated with non-accumulator type HEUI assemblies, and 2) exhibits a falling rate injection during at least the final stages of the injection event and therefore exhibits benefits generally associated with accumulator-type HEUI assemblies. The percentage of the injection event taking place under a falling rate increases generally proportionally with the ratio $V_{ACC}/Q_{MAX}$.

15 Claims, 3 Drawing Sheets

HYBRID HYDRAULIC ELECTRONIC UNIT INJECTOR

BACKGROUND OF THE INVENTION

1. Field of the Invention

The invention relates to hydraulic electronic unit injector (HEUI) assemblies and, more particularly, to a hybrid assembly having some characteristics of a non-accumulator-type HEUI assembly and some characteristics of an accumulator-type HEUI assembly.

2. Discussion of the Related Art

Hydraulic electronic unit injector (HEUI) assemblies have gained increased acceptance in recent years because they permit more precise control of fuel injection rate, timing and quantity than is possible with traditional cam-operated or jerk-type injector assemblies and thus can significantly reduce exhaust emissions and improve fuel economy and power. Both accumulator-type and non-accumulator-type HEUI assemblies are known and both employ pulse width metering or pressure metering to control the timing and quantity of fuel injection. As will now be detailed, however, the manner in which energy for injection is stored and released differs fundamentally between the two types of assemblies, and each type of assembly is considered by some to exhibit advantages lacking in the other type of assembly.

A HEUI assembly generally considered to be of the non-accumulator type is commercially available from Caterpillar, Inc. of Peoria, Ill. and is characterized by a needle assembly, a pressure intensifier assembly, and a solenoid-actuated poppet valve. The poppet valve is operable to selectively connect a low pressure chamber of the pressure intensifier assembly to a source of fluid pressure and to vent, thus pressurizing or depressurizing a high pressure chamber of the intensifier assembly. The high pressure chamber is fluidically coupled to a fuel supply rail and to a nozzle cavity of the needle assembly. The needle lifts to permit injection whenever fluid pressure in the high pressure chamber increases above a designated level (determined primarily by a needle return spring) and closes whenever the fluid pressure in the nozzle cavity decreases beneath this same level.

Non-accumulator type HEUI assemblies exhibit marked drawbacks and disadvantages.

For instance, injection energy must be transferred very rapidly, i.e., simultaneously with injection. This rapid energy transfer requires an extremely fast-acting valve with very high hydraulic flow velocity leading to relatively high parasitic losses. Indeed, for peak injection pressures of about 1200 bar, it is estimated that the injector assembly uses about 5% of engine power.

Secondly, a non-accumulator-type HEUI assembly cannot be used in an expanding cloud injection system (ECI system). An ECI system is one which injects at least a significant portion of each fuel charge at a decreasing rate such that successive fuel droplets have high separating velocities. Injection in this manner prevents droplet agglomeration and stimulates rapid vaporization and mixing of liquid fuel, thus reducing smoke and emissions. The construction and operation of such an ECI system and its advantages are discussed in detail in U.S. Pat. No. 5,392,745 to Beck.

In a non-accumulator-type HEUI assembly, on the other hand, fuel is necessarily ejected at a rate that increases through much of the injection event. Injection at an increasing rate causes successive fuel droplets to travel at higher velocities and leads to droplet agglomeration and undesired rich burning of the fuel vapor emanating from liquid droplets.

Thirdly, fluid pressure in the nozzle cavity of a non-accumulator type HEUI assembly decreases rapidly upon intensifier plunger reversal or spill port opening and accompanying pressure decay, which can result in back flow of combustion gases and very rapid and undamped needle closure which can lead to premature wear and failure of the needle valve and associated seat.

Many of the drawbacks of non-accumulator-type HEUI assemblies can be avoided or at least alleviated through the use of accumulator-type HEUI assemblies. An accumulator-type HEUI assembly differs from a non-accumulator-type HEUI assembly primarily in that it permits the energy for fuel injection to be applied prior to the injection event and to be stored at a location immediately upstream of the needle valve seat until injection actually takes place rather than being applied during the injection event as in a non-accumulator-type injector assembly. Such assemblies are typically characterized by the use of (1) an accumulator in one-way fluid communication with the intensifier high-pressure chamber and in two-way fluid communication with the nozzle cavity and (2) a control cavity which places the high pressure chamber of the intensifier in two-way fluid communication with the upper surface of the needle valve. Intensification of fuel pressure in the high pressure chamber forces fuel into the accumulator but does not immediately lead to injection because lifting forces imposed on the needle by accumulator pressure are opposed by an equal pressure in the control cavity. Injection is initiated by de-energizing a solenoid valve to vent the intensifier low pressure chamber and to reverse plunger movement. The resulting pressure decay in the high pressure chamber and control cavity removes opposing forces on the needle and permits accumulating pressure in the nozzle cavity to lift the needle. Fuel injection terminates when lifting forces imposed by fluid pressure in the nozzle cavity drop below closing forces imposed by a needle return spring and by the then-diminished fluid pressure in the control cavity. Accumulator-type HEUI assemblies of this type are disclosed, for example, in U.S. Pat. No. Re 33,270 to Beck et al.

Accumulator-type HEUI assemblies can employ much slower acting valves than are required by non-accumulator-type HEUI assemblies because the injection energy can be applied at a relatively leisurely pace prior to injection. Intensification in an accumulator-type assembly can take place about one-tenth as fast as is required in a non-accumulator-type assembly with about half the parasitic losses. In addition, because injection takes place solely under the control of pressurized fluid trapped in an accumulator which is at a peak value when injection commences, nearly the entire mass of each fuel charge is injected at a steadily decreasing rate and thus is readily suitable for use in an expanding cloud injection process. Moreover, because fuel pressure in the nozzle cavity ceases to decay upon needle closure, the needle lifting forces imposed thereby never drop more than slightly below the needle closing force and thus serve to damp needle closure, thereby increasing needle life and reducing the chances of premature wear.

Despite the advantages of accumulator-type HEUI assemblies, many in the industry have continued to prefer non-accumulator-type assemblies because of perceived disadvantages of the falling rate injection exhibited by accumulator-type assemblies. Most notably, many are concerned that accumulator-type assemblies produce excessive premixed burning of fuel. In an accumulator-type injector, because nearly all of a designated fuel charge is injected at a falling rate, a relatively high percentage of the total fuel charge is injected in the early phases of the injection event and prior to the start of combustion. Typically, about up to 25% of the total fuel charge may be atomized and mixed with air prior to the start of combustion. The sudden combustion of this premixed fuel causes rapid heat release at the beginning of ignition, with a resulting high noise level and undesirable emissions including smoke, NOx and hydrocarbons. Designers of accumulator-type HEUI assemblies recognized this potential problem and sought to eliminate it by providing rate shaping devices in the injectors which caused a shaped injection event in the form of a slow rate pilot injection followed by a higher rate main charge injection. Delaying injection of the main charge until after injection and ignition of the pilot charge effectively controls premixed burning by essentially eliminating the ignition delay period of the main charge. An accumulator-type HEUI assembly incorporating a rate shaping device is disclosed in U.S. Pat. No. 5,241,935 to Beck et al.

Premixed burning is usually less severe in non-accumulator type HEUI assemblies than in accumulator-type HEUI assemblies because a greater percentage of the total injected charge is injected after ignition commences. Rate shaping devices sometimes desired in accumulator-type assemblies are also considered at times to be necessary in non-accumulator type assemblies, but are often considered unnecessary. Proponents of non-accumulator-type HEUI assemblies believe that this perceived advantage outweighs the disadvantages detailed above; however, for high output turbo-charged diesel engines with injection timing retarded to reduce exhaust emissions, the injection delay period becomes very short and essentially eliminates pre-mixed combustion for both accumulator and non-accumulator type injectors.

OBJECTS AND SUMMARY OF THE INVENTION

It is therefore a principal object of the invention to provide a HEUI assembly which 1) injects fuel at a low rate during at least the initial stages of an injection event and which therefore enjoys the advantage of reduced premixed burning generally associated with non-accumulator type HEUI assemblies, and which 2) injects fuel at a falling rate during at least the final stages of an injection event and which therefore enjoys the advantages of needle damping and ECI generally associated accumulator-type HEUI assemblies.

The inventors have determined, somewhat to their surprise, that an injector having these advantages can be produced quite satisfactorily with no more than minor modifications to an existing non-accumulator type HEUI injector manufactured by Caterpillar, Inc. of Peoria, Ill. More specifically, it has been discovered that although Caterpillar did not intend its HEUI assembly to function in any way as an accumulator-type assembly, a check valve placed into the HEUI assembly solely for blowback avoidance purposes, if placed in the proper location in the assembly and combined with flow passages of suitable volume, can permit the HEUI assembly to function as an accumulator-type HEUI assembly during at least the latter stages of the injection event and to otherwise function as a non-accumulator type HEUI assembly. Even more specifically, the hybrid HEUI assembly includes an injector housing having formed therein 1) a fuel supply passage having an inlet and an outlet, 2) a fuel discharge passage having an inlet communicating with the outlet of the fuel supply passage and having an outlet, and 3) a central axial bore presenting a lower nozzle cavity, the lower nozzle cavity having an inlet connected to the outlet of the fuel discharge passage and having a discharge orifice. Means, such as an intensifier or a pump, are connected to the inlet of the fuel supply passage, for selectively pressurizing fuel. A non-return element is disposed in the fuel discharge passage between the inlet and the outlet thereof, and nozzle needle is disposed in the axial bore and presents a lower needle tip around which is disposed the nozzle cavity. The nozzle needle is slidable in the bore from a seated position closing the discharge orifice to an unseated position permitting fuel ejection from the discharge orifice. An injection event initiates upon needle lift and terminates upon needle closure. A needle return spring applies a downward biasing force to the nozzle needle. A volume $V_{ACC}$ is defined by the nozzle cavity and by the portion of the fuel discharge passage located between the non-return element and the outlet thereof. A maximum quantity $Q_{MAX}$ of fuel is injected from the fuel injector assembly during an injection event. $V_{ACC}/Q_{MAX}$ is between about 1.0 and 10.0.

A secondary object of the invention is to modify the existing Caterpillar HEUI assembly as necessary to achieve falling rate fuel injection during a relatively large proportion of an injection event while maintaining rising rate fuel injection in the initial stages of the event and thereby avoiding premix burning.

This object is achieved by setting $V_{ACC}/Q_{MAX}$ to be between about 3.0 and 7.0, and potentially about 5.0.

A second principal object of the invention is to provide an improved fuel injection method such that the injection event exhibits some qualities of an accumulator-type injection event and some qualities of a non-accumulator-type injection event.

In accordance with another aspect of the invention, this objective is achieved by first providing a fuel injector assembly. The assembly includes an injector housing having formed therein 1) a fuel supply passage for the supply of a pressurized fluid from a fuel source, 2) a fuel discharge passage having an inlet communicating with the fuel supply passage and having an outlet, and 3) a central axial bore presenting a lower nozzle cavity, the lower nozzle cavity having an inlet connected to the outlet of the fuel discharge passage and having a discharge orifice. A non-return element is disposed in the fuel discharge passage between the inlet and the outlet. A nozzle needle is disposed in the axial bore and presents a lower needle tip around which is disposed the nozzle cavity, the nozzle needle being slidable in the bore from a seated position closing the discharge orifice to an unseated position permitting flow out of the discharge orifice. A needle return spring applies a downward biasing force to the nozzle needle. Subsequent steps include pressurizing fuel in the fuel supply passage and the fuel discharge passage up to a peak pressure and during the pressurizing step, lifting the nozzle needle, against the biasing force imposed by the needle return spring, under a lifting force imposed by the fuel, thereby to eject fuel from the discharge orifice and to initiate an injection event, wherein, after the ejection event is initiated, fuel is ejected from the discharge orifice at a rate and a pressure which do not significantly decrease. Subsequent steps include decreasing fuel pressure in the fuel supply passage while the nozzle needle is lifted from its seat and fuel is being ejected from the discharge orifice, then closing the non-return element, thereby trapping a volume of fuel at approximately the peak pressure beneath the non-return element, then ejecting the trapped fuel from the discharge orifice at a rate and a pressure which fall substantially continuously until the lifting force is overcome by the closing force, and then lowering the nozzle needle against the seat to close the discharge orifice and to terminate the injection event. A volume $V_{ACC}$ is defined by the nozzle cavity and by the portion of the fuel discharge passage located between the non-return element and the outlet thereof. A maximum quantity $Q_{MAX}$ of fuel is ejected from the fuel injector assembly during the injection event. $V_{ACC}/Q_{MAX}$ is between about 1.0 and 10.0.

Other objects, features, and advantages of the present invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments are illustrated in the accompanying drawings in which like reference numerals represent like parts throughout, and in which.

DETAILED DESCRIPTION OF THE PREFERRED EMBODIMENT

1. Résumé

Pursuant to the invention, a hybrid hydraulic electronic unit injector (HEUI) assembly, having some characteristics of an accumulator-type assembly and some characteristics of a non-accumulator type assembly, is produced by properly sizing the flow passages of an existing HEUI assembly generally considered to be of the non-accumulator type. The existing HEUI assembly includes an intensifier having a high pressure chamber, a fuel discharge passage leading from the intensifier high pressure chamber to the injector nozzle, and a check valve disposed in the fuel discharge passage for the purpose of preventing combustion gases from blowing past the point of the check valve and into sensitive portions of the injector. The hybrid HEUI assembly is produced by designing the volume of the portion of the fuel discharge passage located downstream of the check valve ($V_{ACC}$) to be between 1.0 and 10.0 times the maximum quantity $Q_{MAX}$ of fuel injected during an injection event. The resulting hybrid assembly 1) exhibits a rising injection rate during at least the initial stages of the injection event and therefore exhibits reduced premix combustion and other benefits generally associated with non-accumulator type HEUI assemblies, and 2) exhibits a falling rate injection during at least the final stages of the injection event and therefore is capable of producing expanding cloud injection, needle closure damping, and other benefits generally associated with accumulator-type HEUI assemblies. The percentage of the injection event which takes place under a falling rate increases generally proportionally with the ratio $V_{ACC}/Q_{MAX}$.

2. Construction and Operation of Hybrid HEUI Assembly

Figure 1:
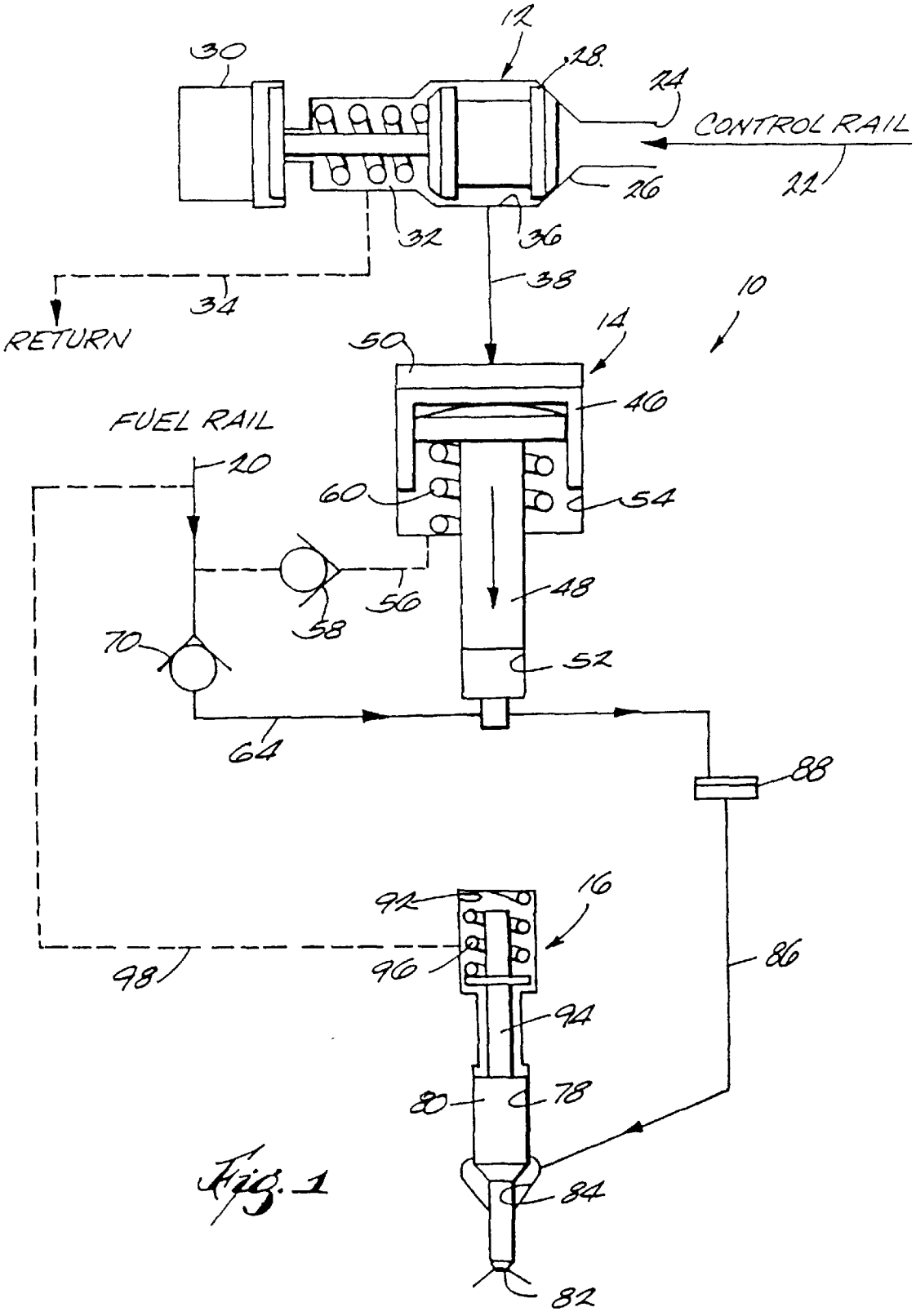
FIG. 1 schematically represents a HEUI assembly usable as the inventive hybrid HEUI assembly.
Figure 2:
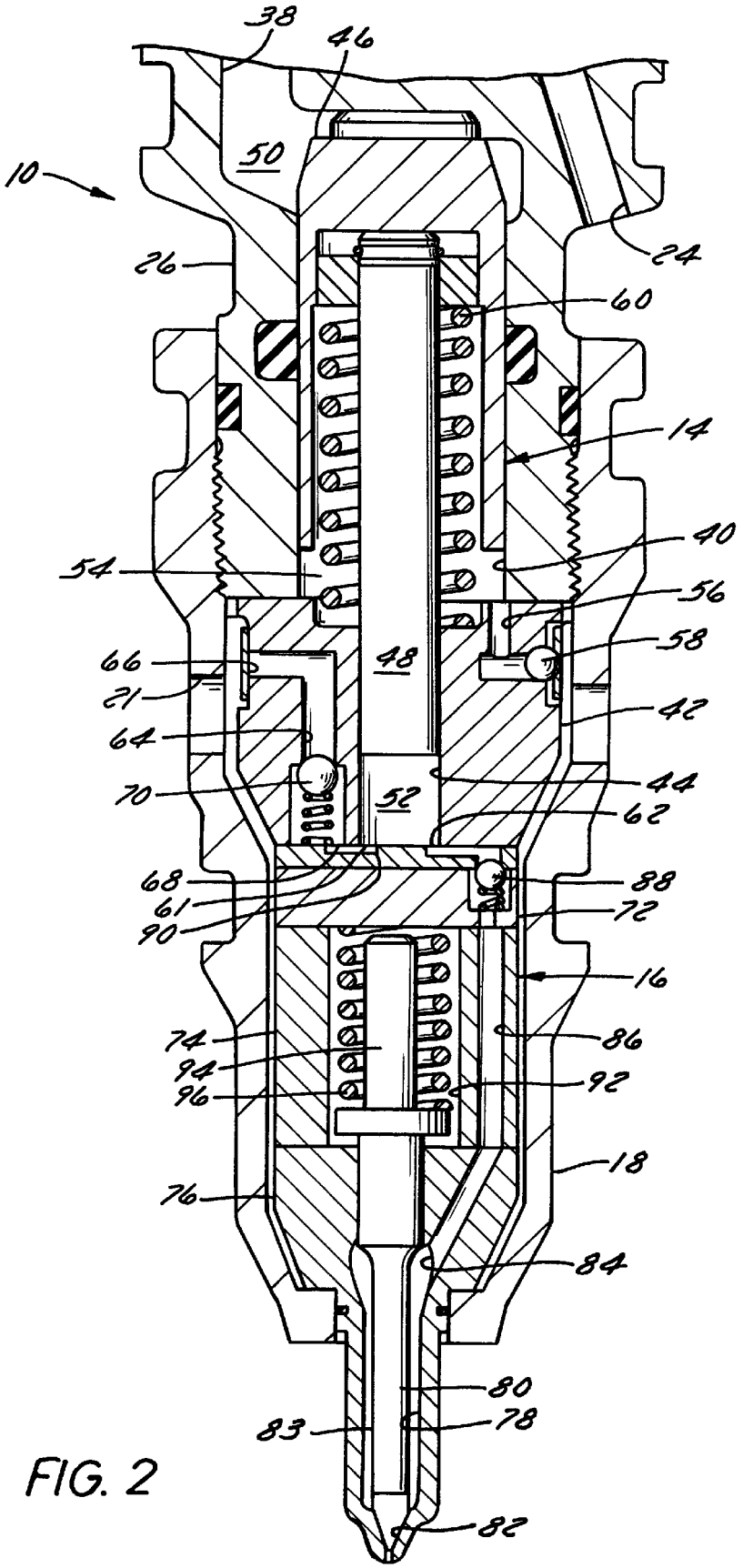
FIG. 2 is a side-sectional-elevation view of the major portion of the HEUI assembly of FIG. 1.

Referring initially to FIGS. 1 and 2, a HEUI assembly 10 is illustrated which is generally of the type manufactured by Caterpillar, Inc. of Peoria, Ill. and disclosed, e.g., in U.S. Pat. No. 5,197,867 to Glassey and U.S. Pat. No. 5,287,838 to Wells. Assembly 10 includes, from upper to lower end, a control valve assembly 12, an intensifier assembly 14, and an injection nozzle assembly 16 all held together by a nut 18. Assembly 10 is connected to a fuel supply rail 20 via a first inlet port 21 formed in nut 18 and is connected to a control rail 22 via a second inlet port 24 formed in a body 26 of the control valve assembly 12. The illustrated control rail 22 is a lube oil supply rail, but could in practice be the fuel supply rail with minor modifications to the assembly 10.

The control valve assembly 12 is designed to selectively pressurize and depressurize a low pressure chamber of the intensifier assembly 14 for reasons detailed below. Assembly 12 includes the body 26 in which is disposed a two-position three-way poppet valve 28 actuated by a solenoid coil 30 (FIG. 1). Valve body 26 has the inlet port 24 formed therein, an outlet port 32 connected to a vent conduit 34 (FIG. 1), and a control chamber 36 which is always connected to the low pressure chamber 50 of the intensifier assembly 14 via a passage 38 and which, depending upon the position of the valve 28, is selectively connected to the control rail 22 or to vent conduit 34. The lower end of the valve body 26 threadedly receives the upper end of nut 18 and has a central axial bore 40 in which is disposed the upper end of the intensifier assembly 14. A spool valve, one or more ball and plunger valves, or any other suitable valves could be used in place of valve 28.

The intensifier assembly 14 comprises a body 42 having a central axial bore 44 formed therein which is aligned with the bore 40 in the valve body 26 and in which is disposed a low-pressure piston 46 and high-pressure plunger 48. Piston 46 and plunger 48 separate the low pressure chamber 50 from a high pressure chamber 52 and define an intermediate chamber 54 which is connected to the fuel supply rail 20 via a passage 56 and a check valve 58 to permit venting of any fluid which leaks into the chamber 54. The piston 46 is biased upwardly by a return spring 60. The high pressure chamber 52 has an inlet 61 and an outlet 62 which is connected to the nozzle needle assembly 16 as will be detailed below. A fuel supply passage 64 is formed in the intensifier body 42 and has an inlet 66 communicating with the first inlet port 21 and an outlet 68 communicating with the high pressure chamber 52 as detailed below. A non-return valve 70 is disposed in the passage 64 and permits fuel to flow freely from the fuel supply rail 20 to the high pressure chamber 52 but prevents return flow therethrough.

The nozzle assembly 16 includes from upper to lower end a spacer or stop member 72, a sleeve 74, and a needle check tip 76 all disposed in axial alignment with one another. A central axial bore 78 is formed in the check tip 76, terminates in a nozzle cavity 82 at its lower end, and is enlarged at an intermediate portion to form a kidney cavity 84. A nozzle needle 80 is disposed in the bore 78 and is stepped so as to be sealed against a guide formed by the upper end portion of the bore 78 but so as to permit unrestricted two-way fluid communications between the kidney cavity 84 and the nozzle cavity 82 through an annulus 83. A fuel discharge passage 86 extends through the spacer 72, sleeve 74, and needle check tip 76 and terminates in the kidney cavity 84, thus fluidically connecting the high pressure chamber 52 to the nozzle cavity 82 via the kidney cavity 84 and annulus 83. Because the annulus 83 and kidney cavity 84 are in constant two-way communication with the fuel discharge passage 86, they can be considered part of the fuel discharge passage 86 for present purposes.

A non-return valve or check valve 88 is located in the fuel discharge passage 86 and prevents return flow from the nozzle cavity 82 to the high pressure chamber 52 for reasons detailed below. This valve may comprise a ball-type valve as illustrated, a flat-disk-type valve, or any other known non-return valve. As can be appreciated from the above, the portion of the fuel discharge passage 86 loaded downstream of check valve 88 (including the cavity 84 and the annulus 83) and the annular nozzle cavity 82 have a combined volume henceforth designated $V_{ACC}$.

The spacer or stop member 72 has a lower face which acts as a stop for the needle 80 and has an upper arcuate cavity 90 which connects the outlet 68 of the fuel supply passage 64 to the inlet 61 of the high pressure chamber 52.

The sleeve 74 defines a spring chamber 92 which receives a needle plunger 94 of the needle 80 as well as a needle return spring 96. The spring chamber 92 is sealed from the fuel discharge passage 86 but has an outlet connected to the fuel supply passage 64 upstream of the check valve 70 via a passage 98 (not shown in FIG. 2) to permit any pressurized fuel that may leak into the chamber 92 during injection to vent back to the fuel supply rail 20, thereby avoiding over pressurization of chamber 92.

In operation, the tip of needle 80 is normally biased into engagement with its seat by the needle return spring 96, thus preventing injection. Injection is initiated by energizing the solenoid coil 30 to switch the control valve 28 from the position illustrated in FIG. 1 to a position in which the low pressure chamber 50 of the intensifier assembly 14 is connected to the control rail 22. Pressurized fluid flows into the low pressure chamber 50 and drives the piston 46 and plunger 48 downwardly to intensify the pressure in the high pressure chamber 52 by a multiple equal to the ratio of the areas of the piston 46 to the plunger 48, typically about 7:1. Pressure increases correspondingly in the fuel discharge passage 86 (including the kidney cavity 84 and the annulus 83) and nozzle cavity 82. Injection commences when the lifting forces imposed on the needle 80 by fluid pressure in the nozzle cavity 82 overcome the return forces imposed by the spring 96, and continues through the downward stroke of the intensifier plunger 48. To terminate injection, solenoid coil 30 is de-energized to reverse the motion of plunger 48, thus depressurizing the high pressure chamber 52, passage 86, and nozzle cavity 82. The needle 80 closes to terminate injection when the lifting forces imposed by the falling fluid pressure in the nozzle cavity 82 are overcome by the forces of the return spring 96. Further upward movement of plunger 48 draws fluid into the high pressure chamber 52 from the fuel supply passage 64 and the check valve 70, thus preparing the assembly 10 for the next injection event.

Except for designation of the volume $V_{ACC}$, a HEUI assembly virtually identical to that as disclosed above is disclosed in the above-mentioned Wells patent. However, according to the text of the Wells patent, the sole purpose of the check valve corresponding to check valve 88 is to prevent blowback at the end of an injection event which otherwise could occur if gas pressures in the combustion chamber were higher than the fuel pressures in the nozzle cavity at the end of the injection event. Another unrecognized effect is to force the closure of the check valve by selecting a rate of decrease of pressure in the intensifier volume that is greater than the rate of decrease of pressure in the volume $V_{ACC}$. The selection of the magnitude of the volume $V_{ACC}$ can also be used to control needle seating velocity and impact stresses. According to the Wells patent, this check valve is designed to close only after termination of an injection event. Stated another way, Wells et al. did not intend any fuel to be injected after check valve closure, and thus did not intend the disclosed HEUI assembly to operate as an accumulator-type injector assembly during any portion of an injection event.

The inventors have discovered that, in reality, fuel is trapped in the volume $V_{ACC}$ beneath the check valve 88 at approximately peak pressure and that injection continues for a time. This post-check valve closure injection accounts for about 5–10% of the total fuel charge injected during an injection event in an assembly configured generally as disclosed in the Wells patent. The inventors have discovered additionally that this post check valve closure injection takes place under a falling rate as in an accumulator type HEUI assembly and that, if the assembly is properly configured, advantage can be taken of this fact to produce a hybrid HEUI assembly.

The inventors have discovered that some injection takes place after the check valve 88 closes because diesel fuel, like any liquid, is compressible to some degree. Therefore, when the check valve 88 closes upon an initial decrease of fluid pressure in the high pressure chamber 52 of the intensifier assembly 14 (occurring when downward motion of the intensifier plunger 48 stops and begins to reverse), compressible fluid under pressure is trapped in the volume $V_{ACC}$ at a pressure which is higher than the needle closing pressure and which is at approximately peak system pressure, thereby keeping the needle open until the pressure in the volume $V_{ACC}$ drops to the needle closing pressure. Hence, injection continues until the pressure in the volume $V_{ACC}$ drops below the pressure at which lifting forces imposed on the needle 80 by decaying fluid pressure in the nozzle cavity 82 are overcome by closing forces imposed by the return spring 96. The inventors have additionally discovered that the assembly 10 operates as an accumulator-type assembly 10 after check valve closure, with falling rate injection and the resulting potential for ECI. The maximum duration of this falling rate injection, and thus the percentage of the total fuel charge mass injected at a falling rate, varies directly with the ratio $V_{ACC}/Q_{MAX}$. $Q_{MAX}$ is the quantity of fuel injected at full load, with smaller quantities being injected under light-load engine operating conditions. When the ratio $V_{ACC}/Q_{MAX}$ is significantly below about 1.0, the percentage of the total fuel charge injectable after check-valve closure is negligible because the needle 80 closes almost immediately after the check valve 88 closes. At a ratio $V_{ACC}/Q_{MAX}$ of about 1.0, as appears to be the case in the commercial version of the HEUI assembly disclosed in the Wells patent and manufactured by Caterpillar, about 5–10% of the total charge is injected at a falling rate, i.e., after the check valve closes. When the ratio $V_{ACC}/Q_{MAX}$ is 10 or higher, nearly the entire fuel mass is injected following closure of the check valve 88. $V_{ACC}$ can be increased in the assembly 10 by increasing the diameter of fuel discharge passage 86 during manufacture by adding additional passages in fluid communication with the passage 86; by sealing the spring chamber 92 and by placing in fluid communication with passage 86 (thereby making it part of passage 86) and simultaneously sealing the upper end of plunger 94 from the spring chamber; or by any other suitable measure.

Figure 3:
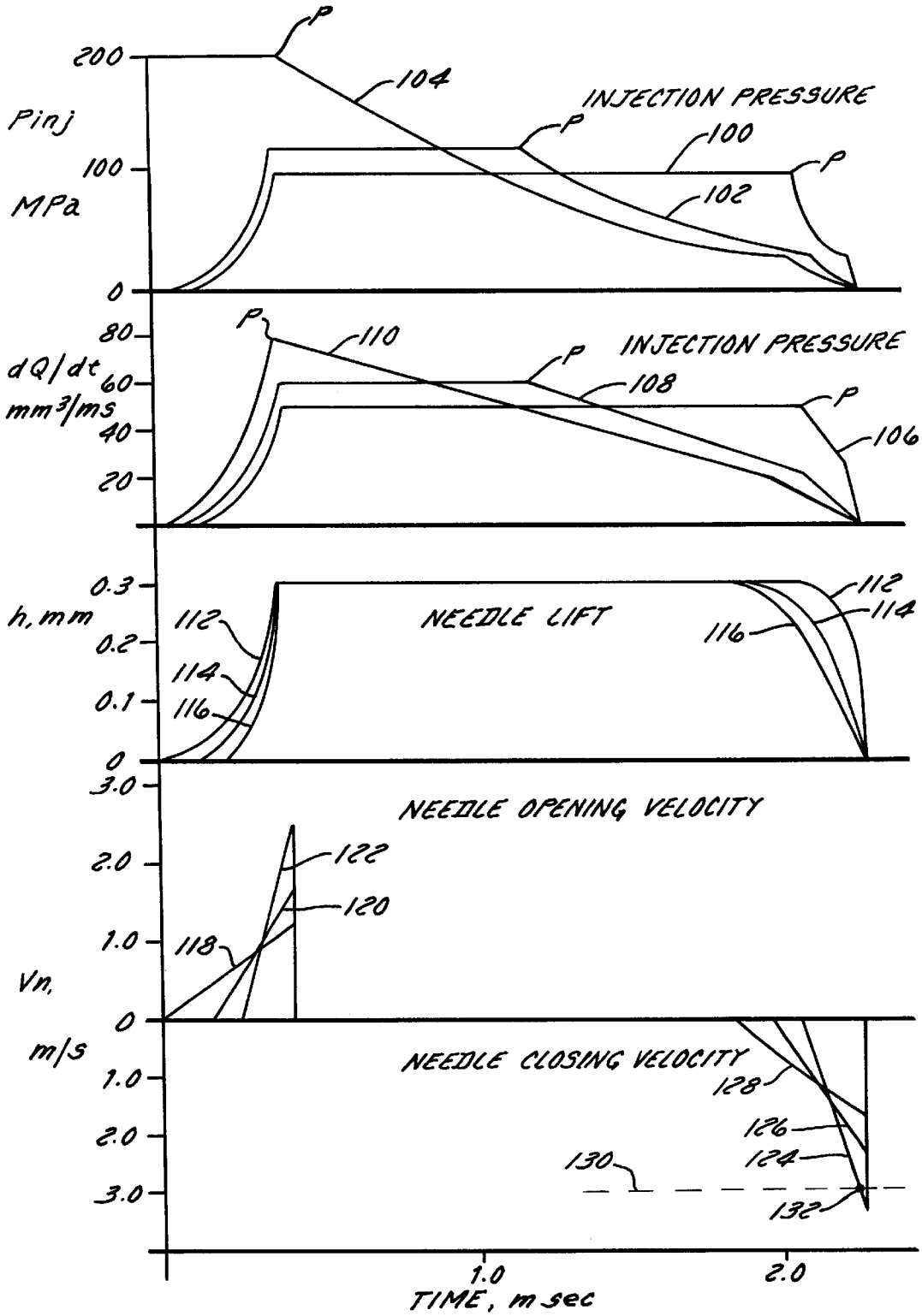
FIG. 3 is a series of graphs illustrating variations in injection pressure, injection rate, needle lift, and needle opening and closing velocities with time for three different hybrid HEUI assemblies.

The effects of injection after check valve closure and variations in injection characteristics resulting from variations in the ratio $V_{ACC}/Q_{MAX}$ will be better understood from a discussion of FIG. 3, which illustrate injection characteristics for three configurations of the hybrid injector during he injection of $Q_{MAX}$.

First, the curves 100, 102, and 104 indicate that as the ratio $V_{ACC}/Q_{MAX}$ increases, the percentage of the injection event that takes place under a falling pressure increases dramatically. Since injection pressure and injection rate are directly related to one another, the percentage of the injection event that takes place under a falling rate also increases dramatically with increases in the ratio $V_{ACC}/Q_{MAX}$ as can be seen from the curves 106, 108, and 110. Of these curves, curves 100 and 106 illustrate injection pressure and injection rate within an assembly in which the ratio $V_{ACC}/Q_{MAX}$ is 1.0; curves 102 and 108 illustrate injection pressure and injection rate when the ratio $V_{ACC}/Q_{MAX}$ is 5.0; and curves 104 and 110 illustrate injection pressure and injection rate when the ratio $V_{ACC}/Q_{MAX}$ is 10.0. The point P in each of these curves is the point at which the check valve 88 closes.

The balance between premixed burning and falling rate injection is largely a matter of designer preference, with proponents of accumulator-type HEUI assemblies being willing to risk some premixed burning (or to incorporate a rate shaping device) to obtain the benefits of falling rate injection and proponents of non-accumulator-type HEUI assemblies being willing to forego the advantages of falling rate injection to reduce the likelihood of premixed burning. Hence, proponents of accumulator-type HEUI assemblies would likely select a ratio $V_{ACC}/Q_{MAX}$ of 10 or higher to obtain an assembly similar in operation to an accumulator-type assembly, proponents of non-accumulator-type HEUI assemblies would likely select the ratio $V_{ACC}/Q_{MAX}$ to be little more than 1 to obtain an assembly similar in operation to a non-accumulator-type assembly, and those seeking to maximize the benefits of both types of assemblies would be likely to seek a ratio $V_{ACC}/Q_{MAX}$ of between about 3.0 and 7.0, most probably about 5.0.

It is important to note that a hybrid assembly is obtained whether the ratio $V_{ACC}/Q_{MAX}$ is selected to be 10.0 or higher, 1.0, or somewhere in between.

For instance, in a true accumulator-type assembly, intensifier pressure is imposed on the upper end of the needle as a closing force until the intensifier piston reverses its direction of movement. The application of this closing force limits injection at a rising rate to that portion of the injection event in which the needle is only partially open. In the hybrid injector 10, however, this fluid pressure closing force is absent, and the needle 80 is free to lift whenever the fluid pressure in the volume $V_{ACC}$ exceeds a value in which the lifting portions imposed by this fluid pressure are overcome by the return forces imposed by the needle return spring 96 even when $V_{ACC}/Q_{MAX}$ is relatively large.

Moreover, in the absence of check valve 88, injection would cease virtually immediately after intensifier piston reversal (or as soon as the rate of decrease in intensifier pressure is greater than that in the volume $V_{ACC}$), and virtually no fuel would be injected at a falling rate. However, because diesel fuel and any other liquid fuels are compressible to some degree, injection of fuel trapped upon the closure of the check valve 88 of the hybrid assembly 10 will continue at a falling rate until the pressure in the volume $V_{ACC}$ drops below needle closing pressure even if $V_{ACC}/Q_{MAX}$ is no more than about 1. This is a fact that Wells and others employing blowback prevention check valves appeared never to recognize, or they would have taken measures to achieve needle closure concurrently with or even before check valve closure to obtain the desired rising or steady rate injection for the entire fuel charge. Assuming for the moment that the volume $V_{ACC}$ in the assembly disclosed in the Wells patent or the corresponding commercial device manufactured by Caterpillar is sufficiently large to achieve significant injection after check valve closure, the Wells patent and other writings confirm that neither Caterpillar nor anyone else 1) intended any injection after check valve closure, 2) appreciated that such post-closure injection was occurring, or 3) appreciated that the falling-rate injection characteristic of accumulator-type injection occurred during that post-closure injection.

Additional benefits are achieved through the inventive hybrid accumulator/non-accumulator HEUI assembly 10 in addition to the combination of rising rate/pressure and falling rate/pressure discussed above.

For instance, the inventors have discovered that needle opening velocity varies directly with increases in $V_{ACC}/Q_{MAX}$, and that needle closing velocity varies inversely with variations in $V_{ACC}/Q_{MAX}$. Thus, the curves 118 and 124 illustrate needle opening and needle closing velocity at $V_{ACC}/Q_{MAX}$ of 1.0; the curves 120 and 126 illustrate corresponding values at $V_{ACC}/Q_{MAX}$ of 5.0; and the curves 122 and 128 illustrate corresponding values at $V_{ACC}/Q_{MAX}$ of 10.0. The resulting needle lift is represented by the curves 112, 114, and 116, which represent needle opening at $V_{ACC}/Q_{MAX}$ ratios of 1.0, 5.0, and 10.0, respectively. Significant here is the discovery that the needle damping effect resulting from accumulator-type (falling rate) injection occurring after check valve closure increases with increases in $V_{ACC}/Q_{MAX}$. Needle damping occurs because the lifting forces imposed on the needle 80 by the trapped fluid in the volume $V_{ACC}$ resist needle closure. Resistance to needle closure and hence needle damping decrease with pressure decay in the volume $V_{ACC}$. As $V_{ACC}$ increases, the rate of pressure decay decreases, and the magnitude of needle damping at the end of an injection event increases.

Needle damping is important because rapid needle closure, though desired by many for assuring a rapid end to an injection event, risks impact stress and damage to the needle and/or valve seat. The maximum permissible needle closing velocity is generally represented in the art by an impact velocity limit illustrated by the phantom line 130 in FIG. 3. If the needle closing velocity meets or exceeds this limit, damage to the needle and/or seat may occur. The curve 124 illustrates that there is a danger that the impact velocity limit may be reached if $V_{ACC}/Q_{MAX}$ is less than about 1.0 unless the needle 80 and needle return spring 96 are properly dimensioned and configured (note the point of intersection 132 of the curve 124 and the line 130). However, as the ratio $V_{ACC}/Q_{MAX}$ increases, needle damping increases rather quickly to above a level at which needle closure is damped sufficiently to preclude serious risk of damage or premature wear of the injector. Needle damping therefore provides yet another justification for configuring the volume $V_{ACC}$ to be sufficiently large to permit the HEUI assembly 10 to function as an accumulator-type assembly during a substantial portion of the injection event.

Needle damping, if present in the HEUI assembly disclosed in the Wells patent and in Caterpillar's corresponding commercial assembly, provides still further evidence that Caterpillar did not intend to design a hybrid assembly and did not appreciate the results of any hybrid assembly it may have produced. There is much discussion in the literature, including literature published by Caterpillar, of the importance of obtaining rapid needle closure to prevent blowback and to obtain other results viewed as beneficial. Caterpillar added the check valve to its fuel supply passage precisely because it was concerned about blowback and wanted to avoid its consequences. If Caterpillar had realized that, by adding the check valve, it would damp needle closure and increase the likelihood of blowback and other undesired consequences, it would not have added the check valve or would have taken auxiliary measures to accelerate needle closure. No such additional measures were taken.

Another potential advantage is the prevention of any blowback into the injector assembly. The stated purpose of Wells' check valve is to preclude combustion gases, which are presumed to flow into the injector assembly near the end of the injection event, from blowing past the check valve and into what must be considered to be more sensitive portions of the assembly. Blowback of some gases into the volume $V_{ACC}$ apparently is still anticipated. However, if the needle closing pressure and check-valve closing pressure are properly selected, trapped fuel pressure in the volume $V_{ACC}$ can prevent any combustion gases from blowing into the injector—even into the volume $V_{ACC}$.

In summary, while the addition of the blowback prevention check valve to the HEUI assembly disclosed in the Wells patent may have produced a structure generally corresponding to the inventive hybrid accumulator/non-accumulator type HEUI assembly 10 in which injection falls at a generally steady rate in at least the latter stages of an injection event, i.e., after the check valve 88 closes, Wells did not intend to produce such a hybrid assembly. Indeed, Wells sought directly the opposite result, namely, injection termination at or even before check valve closure. Nor were the existence of falling rate injection or the resultant effects appreciated by Wells or anyone else in the art prior to the inventors' design of the hybrid assembly 10 with a ratio $V_{ACC}/Q_{MAX}$ of 1.0 or higher. Moreover, while it has been discovered that at least a small fraction of falling rate injection will take place after check valve closure in Wells' assembly, the benefits of needle damping and appreciable ECI benefits occur only if $V_{ACC}/Q_{MAX}$ is above 1.0.

Many changes and modifications could be made to the invention without departing from the spirit therefore. The scope of such changes will become apparent from the appended claims.

We claim:

1. A fuel injector assembly comprising:

(A) an injector housing having formed therein (1) a fuel supply passage having an inlet and an outlet, (2) a fuel discharge passage having an inlet communicating with said outlet of said fuel supply passage and having an outlet, and (3) a central axial bore presenting a lower nozzle cavity, said lower nozzle cavity having an inlet connected to said outlet of said fuel discharge passage and having a discharge orifice;

(B) means, connected to said inlet of said fuel supply passage, for selectively pressurizing fuel;

(C) a non-return element disposed in said fuel discharge passage between said inlet and said outlet thereof;

(D) a nozzle needle disposed in said axial bore and presenting a lower needle tip around which is disposed said nozzle cavity, said nozzle needle being slidable in said bore from a seated position closing said discharge orifice to an unseated position permitting fuel ejection from said discharge orifice, an injection event initiating upon needle lift and terminating upon needle closure; and (E) a needle return spring applying a downward biasing force to said nozzle needle, wherein a volume $V_{ACC}$ is defined by said nozzle cavity and by the portion of said fuel discharge passage located between said non-return element and said outlet thereof, wherein a maximum quantity $Q_{MAX}$ of fuel is injected from said fuel injector assembly during an injection event, and wherein said means for pressurizing fuel, said needle return spring, said check valve, and said volume $V_{ACC}$ are dimensioned and configured such that $V_{ACC}/Q_{MAX}$ is more than about 1.0 and is no more than about 10.0.

2. A fuel injector assembly comprising:

(A) an injector housing having formed therein (1) a fuel supply passage having an inlet and an outlet, (2) a fuel discharge passage having an inlet communicating with said outlet of said fuel supply passage and having an outlet, and (3) a central axial bore presenting a lower nozzle cavity, said lower nozzle cavity having an inlet connected to said outlet of said fuel discharge passage and having a discharge orifice;

(B) means, connected to said inlet of said fuel supply passage, for selectively pressurizing fuel;

(C) a non-return element disposed in said fuel discharge passage between said inlet and said outlet thereof;

(D) a nozzle needle disposed in said axial bore and presenting a lower needle tip around which is disposed said nozzle cavity, said nozzle needle being slidable in said bore from a seated position closing said discharge orifice to an unseated position permitting fuel ejection from said discharge orifice, an injection event initiating upon needle lift and terminating upon needle closure; and (E) a needle return spring applying a downward biasing force to said nozzle needle, wherein a volume $V_{ACC}$ is defined by said nozzle cavity and by the portion of said fuel discharge passage located between said non-return element and said outlet thereof, wherein a maximum quantity $Q_{MAX}$ of fuel is injected from said fuel injector assembly during an injection event, and wherein $V_{ACC}/Q_{MAX}$ is between about 3.0 and 7.0.

3. An injector assembly as defined in claim 2, wherein $V_{ACC}/Q_{MAX}$ is about 5.0.

4. An injector assembly as defined in claim 1, wherein said non-return element comprises one of a ball-type check valve and a flat-disc-type check valve.

5. An injector assembly as defined in claim 1, wherein said needle return spring applies substantially the entire downwardly biasing force to said needle.

6. An injector assembly as defined in claim 5, wherein a spring chamber is formed in said housing, and wherein said needle return spring and an upper end of said nozzle needle are disposed in said spring chamber.

7. An injector assembly as defined in claim 1, wherein said means for selectively pressurizing comprises an intensifier having a relatively large diameter piston surface and a relatively small diameter plunger surface, a low pressure chamber being formed fluidically above said piston surface and being selectively connectable to a source of pressurized fluid and to vent, and a high pressure chamber being formed fluidically beneath said plunger surface and being connected to said fuel supply passage.

8. A hydraulic electronic unit fuel injector assembly comprising:

(A) an injector housing having formed therein (1) a fuel supply passage for the supply of a pressurized fluid, said fuel supply passage having an inlet and an outlet, (2) a fuel discharge passage having an inlet communicating with said outlet of said fuel supply passage and having an outlet, and (3) a central axial bore presenting a lower nozzle cavity, said lower nozzle cavity having an inlet connected to said outlet of said fuel discharge passage and having a discharge orifice;

(B) a non-return element disposed in said fuel discharge passage between said inlet and said outlet, said non-return element comprising one of a ball-type check valve and a flat-disc-type check valve;

(C) a nozzle needle disposed in said axial bore and presenting a lower needle tip around which is disposed said nozzle cavity, said nozzle needle being slidable in said bore from a seated position closing said discharge orifice to an unseated position permitting flow out of said discharge orifice;

(D) a needle return spring applying a downward biasing force to said nozzle needle, wherein a spring chamber is formed in said housing, wherein said needle return spring and an upper end of said nozzle needle are disposed in said spring chamber, and wherein a bleed passage leads from said spring chamber to a low-pressure reservoir; and (E) an intensifier having a relatively large diameter piston surface and a relatively small diameter plunger surface, a low pressure chamber being formed fluidically above said piston surface and being selectively connectable to a source of pressurized fluid and to vent, and a high pressure chamber being formed fluidically beneath said plunger surface and being connected to said inlet of said fuel supply passage, wherein a volume $V_{ACC}$ is defined by said nozzle cavity and by the portion of said fuel discharge passage located between said non-return element and said outlet thereof, wherein a maximum quantity $Q_{MAX}$ of fuel is injected from said fuel injector assembly during an injection event, and wherein $V_{ACC}/Q_{MAX}$ is between about 3.0 and about 7.0.

9. A method of injecting fuel, comprising:

(A) providing a fuel injector assembly including (1) an injector housing having formed therein (a) a fuel supply passage for the supply of a pressurized fluid from a fuel source, (b) a fuel discharge passage having an inlet communicating with said fuel supply passage and having an outlet, and (c) a central axial bore presenting a lower nozzle cavity, said lower nozzle cavity having an inlet connected to said outlet of said fuel discharge passage and having a discharge orifice, (2) a non-return element disposed in said fuel discharge passage between said inlet and said outlet thereof;

(3) a nozzle needle disposed in said axial bore and presenting a lower needle tip around which is disposed said nozzle cavity, said nozzle needle being slidable in said bore from a seated position closing said discharge orifice to an unseated position permitting flow out of said discharge orifice, and (4) a needle return spring applying a downward biasing force to said nozzle needle;

(B) pressurizing fuel in said fuel supply passage and said fuel discharge passage up to a peak pressure;

(C) during said pressurizing step, lifting said nozzle needle, against the biasing force imposed by said needle return spring, under a lifting force imposed by said fuel, thereby to eject fuel from said discharge orifice and to initiate an injection event, wherein, after said ejection event is initiated, fuel is ejected from said discharge orifice at a rate and a pressure which do not significantly decrease; then (D) decreasing fuel pressure in said fuel supply passage while said nozzle needle is lifted from its seat and fuel is being ejected from said discharge orifice; then (E) closing said non-return element, thereby trapping a volume of fuel at approximately said peak pressure beneath said non-return element; then (F) ejecting said trapped fuel from said discharge orifice at a rate and a pressure which fall substantially continuously until said lifting force is overcome by said closing force; and then (G) lowering said nozzle needle against said seat to close said discharge orifice and to terminate said injection event, wherein a volume $V_{ACC}$ is defined by said nozzle cavity and by the portion of said fuel discharge passage located between said non-return element and said outlet thereof, wherein a maximum quantity $Q_{MAX}$ of fuel is ejected from said fuel injector assembly during an injection event, and wherein $V_{ACC}/Q_{MAX}$ is more than about 1.0 and is no more than about 10.0.

10. A method of injecting fuel, comprising:

(A) providing a fuel injector assembly including (1) an injector housing having formed therein (a) a fuel supply passage for the supply of a pressurized fluid from a fuel source, (b) a fuel discharge passage having an inlet communicating with said fuel supply passage and having an outlet, and (c) a central axial bore presenting a lower nozzle cavity said lower nozzle cavity having an inlet connected to said outlet of said fuel discharge passage and having a discharge orifice;

(2) a non-return element disposed in said fuel discharge passage between said inlet and said outlet thereof;

(3) a nozzle needle disposed in said axial bore and presenting a lower needle tip around which is disposed said nozzle cavity, said nozzle needle being slidable in said bore from a seated position closing said discharge orifice to an unseated position permitting flow out of said discharge orifice, and (4) a needle return spring applying a downward biasing force to said nozzle needle;

(B) pressurizing fuel in said fuel supply passage and said fuel discharge passage up to a peak pressure;

(C) during said pressurizing step, lifting said nozzle needle, against the biasing force imposed by said needle return spring, under a lifting force imposed by said fuel, thereby to eject fuel from said discharge orifice and to initiate an injection event, wherein, after said ejection event is initiated, fuel is ejected from said discharge orifice at a rate and a pressure which do not significantly decrease; then (D) decreasing fuel pressure in said fuel supply passage while said nozzle needle is lifted from its seat and fuel is being ejected from said discharge orifice; then (E) closing said non-return element, thereby trapping a volume of fuel at approximately said peak pressure beneath said non-return element; then (F) ejecting said trapped fuel from said discharge orifice at a rate and a pressure which fall substantially continuously until said lifting force is overcome by said closing force; and then (G) lowering said nozzle needle against said seat to close said discharge orifice and to terminate said injection event, wherein a volume $V_{ACC}$ is defined by said nozzle cavity and by the portion of said fuel discharge passage located between said non-return element and said outlet thereof, wherein a maximum quantity $Q_{MAX}$ of fuel is ejected from said fuel injector assembly during an injection event, and wherein $V_{ACC}/Q_{MAX}$ is between about 3.0 and 7.0.

11. A method as defined in claim 9, wherein $V_{ACC}/Q_{MAX}$ is about 5.0.

12. A method as defined in claim 9, wherein said pressurizing step comprises trapping fuel in a high pressure chamber of an intensifier having a relatively large diameter piston surface and a relatively small diameter plunger surface, a low pressure chamber being formed fluidically above said piston surface and being selectively connectable to a source of pressurized fluid and to vent, and said high pressure chamber being formed fluidically beneath said plunger surface and being connected to said fuel supply passage, and admitting a pressurized fluid into said low pressure chamber, thereby driving said plunger surface towards said high pressure chamber and increasing the pressure level of fuel in said high pressure chamber.

13. A method as defined in claim 12, wherein said decreasing step is initiated by reversing a direction of movement of said plunger surface of said intensifier.

14. A method as defined in claim 9, wherein, during the step (E), fuel is trapped at a pressure level which is higher than a peak combustion pressure so as to prevent blowback of combustion gases into said fuel injector.

15. A method as defined in claim 9, further comprising selecting the magnitude of said volume $V_{ACC}$ and the force of said needle return spring to limit a needle seating velocity to a level beneath an impact velocity limit.

* * * * *

UNITED STATES PATENT AND TRADEMARK OFFICE

CERTIFICATE OF CORRECTION

PATENT NO. : 5,823,429
DATED : October 20, 1998
INVENTOR(S) : Beck et al.

It is certified that error appears in the above-identified patent and that said Letters Patent is hereby corrected as shown below:

Col. 8, line 65, after "which" delete "illustrate" and insert --illustrates--.
Col. 8, line 67, delete "he" and insert --the--.
Col. 12, line 3, after "said" delete "check valve" and insert --non-return element--.
Col. 13, line 62, after "said" delete "ejection" and insert --injection--.
Col. 14, line 46, after "said" delete "ejection" and insert --injection--.

Signed and Sealed this

Thirteenth Day of April, 1999

*Attest:*

Q. TODD DICKINSON

*Attesting Officer*

*Acting Commissioner of Patents and Trademarks*